US012565295B2

(12) United States Patent
Inoue

(10) Patent No.: US 12,565,295 B2
(45) Date of Patent: Mar. 3, 2026

(54) WATERCRAFT TROUBLESHOOTING SUPPORT SYSTEM, AND SERVER, COMMUNICATION TERMINAL AND CLIENT TERMINAL FOR THE WATERCRAFT TROUBLESHOOTING SUPPORT SYSTEM

(71) Applicant: YAMAHA HATSUDOKI KABUSHIKI KAISHA, Iwata (JP)

(72) Inventor: Ryota Inoue, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 174 days.

(21) Appl. No.: 18/517,360

(22) Filed: Nov. 22, 2023

(65) Prior Publication Data

US 2024/0174330 A1 May 30, 2024

(30) Foreign Application Priority Data

Nov. 25, 2022 (JP) ..... 2022-188464

(51) Int. Cl.
*B63B 79/10* (2020.01)
*B63B 79/20* (2020.01)
*B63B 79/30* (2020.01)

(52) U.S. Cl.
CPC ..... *B63B 79/30* (2020.01); *B63B 79/10* (2020.01); *B63B 79/20* (2020.01)

(58) Field of Classification Search
CPC ..... B63B 79/10; B63B 79/20; B63B 79/30
See application file for complete search history.

(56) References Cited

U.S. PATENT DOCUMENTS

2002/0103582 A1* 8/2002 Ohmura ..... G07C 5/008 701/31.4
2003/0061076 A1* 3/2003 Okuyama ..... G06Q 40/08 705/4
2005/0021294 A1* 1/2005 Trsar ..... G16H 50/20 702/183
2020/0339235 A1* 10/2020 Inoue ..... B63B 79/30

FOREIGN PATENT DOCUMENTS

WO 2016/098198 A1 6/2016

* cited by examiner

*Primary Examiner* — Stephen Holwerda
(74) *Attorney, Agent, or Firm* — Keating & Bennett, LLP

(57) ABSTRACT

A watercraft troubleshooting support system includes a communication terminal configured or programmed to transmit watercraft configuration information; a server configured or programmed to receive the configuration information transmitted by the communication terminal, accumulate at least the configuration information for a plurality of watercraft, and generate a test item for each of the watercraft based on the accumulated configuration information; and a client terminal configured or programmed to communicate with the server, transmit condition data for a specific one of the watercraft to the server, apply a test item request to the server, receive a test item from the server based on the test item request, and provide the test item to a user.

12 Claims, 9 Drawing Sheets

FIG. 4

M

- Model-specific operation master information
  Model name
  Component information (e.g., With built-in electric steering unit)
    Individual operation information
      Object component (e.g., Electric steering unit)
        Problem condition (e.g., Steering inoperable)
        Relevant sensor value (e.g., Input command value,
                steering electric current value, actual steering angle)
        Abnormality determination scoring information
          Determination condition (Example 1: When steering error is detected,
                abnormality score is increased by +10.)
                (Example 2: When difference between operation
                amount and output value is greater than 30%,
                abnormality score is increased by +5.)
          Specific condition (e.g., When steering error is detected at middle position,
                abnormality score for port-side position is increased by +5.)
        Recovery operation (e.g., Supply voltage of not less than 14 V and continuity of
                communication line between steering units)

- Model-specific operation master information
  Model name
  .....

FIG. 9

Condition

Configuration information : Three outboard motors

Problem information : Steering error of middle steering unit

Sensor values : Steering operation amount=1, Steering output=0

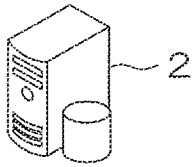

| Object device | Abnormality score |
|---|---|
| Middle steering unit | 15 |
| Port-side steering unit | 5 |
| Helm unit | 3 |
| Remote control unit | 1 |

| |
|---|
| Middle steering unit: Inoperable |
| Check power supply |
| Check communication line continuity |

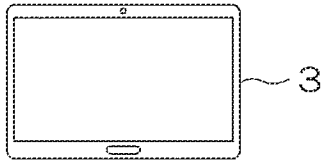

Input

Input of condition: Steering unit inoperable

Measurement and redetermination: Start acquiring sensor detection values

Input of measurement values and redetermination: Supply voltage of middle steering unit is 15V, Continuity is established

WATERCRAFT TROUBLESHOOTING SUPPORT SYSTEM, AND SERVER, COMMUNICATION TERMINAL AND CLIENT TERMINAL FOR THE WATERCRAFT TROUBLESHOOTING SUPPORT SYSTEM

CROSS REFERENCE TO RELATED APPLICATIONS

This application claims the benefit of priority to Japanese Patent Application No. 2022-188464 filed on Nov. 25, 2022. The entire contents of this application are hereby incorporated herein by reference.

BACKGROUND OF THE INVENTION

1. Field of the Invention

The present invention relates to a watercraft troubleshooting support system, and a server, a communication terminal, and a client terminal for the watercraft troubleshooting support system.

2. Description of the Related Art

Small watercraft typified by outboard motor boats significantly vary in configuration. That is, completely unlike motor vehicles each having a configuration mostly determined by vehicle type and model, watercraft each have a configuration determined according to a customer's request and method of use. A boat builder assembles a watercraft from a hull, a main device (main propulsion device), auxiliary devices, and other components selected based on the customer's request and the like. Further, the watercraft are generally modified by the addition, removal and/or replacement of devices after being sold. As a result, the watercraft substantially vary in configuration with different configuration patterns and with correspondingly different behavior patterns. With different propeller structures, different hull bottom shapes and the like and with the provision of different fishing gear, for example, the watercraft vary in acceleration characteristics, watercraft speed characteristics, engine rotation speed characteristics and the like.

SUMMARY OF THE INVENTION

The inventor of preferred embodiments of the present invention described and claimed in the present application conducted an extensive study and research regarding the troubleshooting of a watercraft, such as the one described above, and in doing so, discovered and first recognized new unique challenges and previously unrecognized possibilities for improvements as described in greater detail below.

If a watercraft has a problem, the user of the watercraft contacts a dealer or the like. Then, a dealer's engineer checks the watercraft, and performs a repair operation as required. However, the engineer cannot check auxiliary devices, wiring cables and the like incorporated inside the hull of the watercraft from the outside, and often does not understand the configurations (the types, the numbers, the connection states, and the like) of the auxiliary devices, the wiring cables and the like. In addition, as described above, the watercraft configuration varies from watercraft to watercraft and, therefore, it is difficult to provide a standard test procedure. Even with the provision of the standard test procedure, the watercraft may have specifications falling outside the standard test procedure and, in this case, a useless operation is likely to be performed. Particularly, the auxiliary devices, the wiring cables and the like are often incorporated in inner portions of the hull inaccessible without removing a water-proof hull component. Therefore, the useless operation results in significant loss in time and effort. In addition, there is a possibility that the occurrence of abnormality in the watercraft, an abnormal condition of the watercraft and the like cannot be properly determined by the standard test procedure depending on the configuration of the watercraft.

WO 2016/098198A1 discloses an operation management system in which device state data indicating the states of a plurality of devices provided in a watercraft is acquired and, if the device state data indicates an abnormality, an operator in charge of resolving the abnormality is designated and operation data is transmitted to a terminal device carried by the operator. However, this operation management system includes a server device provided in a large-scale watercraft, and is configured to cause the server device to generate operation data about the abnormalities of any of the plurality of devices provided in the watercraft. That is, the operation management system is dedicated to the single large-scale watercraft. Therefore, the operation management system cannot provide operation procedures suitable for a plurality of watercraft (particularly, small-scale watercraft) having different configurations.

A preferred embodiment of the present invention provides a watercraft troubleshooting support system that is able to properly provide test items suitable for any of a plurality of watercraft having different configurations.

Other preferred embodiments of the present invention provide a server, a communication terminal, and a client terminal for such a watercraft troubleshooting support system.

In order to overcome the previously unrecognized and unsolved challenges described above, a preferred embodiment of the present invention provides a watercraft troubleshooting support system including a communication terminal configured or programmed to transmit watercraft configuration information; a server configured or programmed to receive the configuration information transmitted by the communication terminal, accumulate at least the configuration information for a plurality of watercraft, and generate a test item for each of the watercraft based on the accumulated configuration information; and a client terminal configured or programmed to communicate with the server, transmit condition data for a specific one of the watercraft to the server, apply a test item request to the server, receive a test item from the server based on the test item request, and provide the test item to a user.

With this arrangement, the watercraft configuration information is transmitted to the server by the communication terminal so that the server can generate a test item according to the configuration of each of the watercraft. The watercraft configuration information is transmitted from the communication terminal to the server and, therefore, even if the configuration of the watercraft is retrospectively modified by replacement or addition of a device, the server is able to generate a test item suitable for the latest configuration of the watercraft.

When a problem condition appears in the specific one of the watercraft, the condition data is transmitted from the client terminal to the server, and the test item is transmitted from the server to the client terminal according to the condition data. Therefore, an operator can properly find a test item suitable for the configuration of each of the watercraft by operating the client terminal. This makes it possible to eliminate the problem occurring in the watercraft with a reduced effort in a shorter period of time while reducing or minimizing a useless test procedure. That is, the operator does not need to select test items from a huge number of test items and prioritize the selected test items after understanding the situation of the watercraft and organizing the information.

The communication terminal may periodically transmit the watercraft configuration information to the server. If configuration information collected in the watercraft is altered, the communication terminal may transmit the latest configuration information to the server.

In a preferred embodiment of the present invention, the configuration information includes information about one or more devices of the watercraft. The devices of the watercraft herein include a hull and watercraft devices (rigging devices) provided in the hull. The configuration information about the hull may be information that specifies, for example, the configuration of the hull (a hull bottom shape and the like) and, specifically, may be the model name of the hull. The watercraft devices are typically categorized into a main device and an auxiliary device. The main device herein refers to a main propulsion device that applies a propulsive force to the hull for sailing. The auxiliary device herein refers to a watercraft device other than the main device, and examples of the auxiliary device include watercraft maneuvering devices such as a steering wheel, a remote controller (acceleration lever), a steering unit, and a gauge; auxiliary watercraft maneuvering devices such as an autopilot device and a GNSS (Global Navigation Satellite System) receiver, fishing gear such as a fish finder; and comfort devices such as an air conditioner and a vibration damper.

The communication terminal does not need to upload all the configuration information to the server, but some of the configuration information (e.g., the information about the hull) may be written in the server by a proper terminal device such as the client terminal.

In a preferred embodiment of the present invention, the one or more devices may include at least one main device. With this arrangement, the information about the main device (main propulsion device) which is an important device of the watercraft is accumulated in the server. If a problem condition occurs at least in the main device, therefore, information about a proper test item can be speedily acquired. Thus, a problem occurring in the main device can be speedily eliminated.

In a preferred embodiment of the present invention, the configuration information includes information indicating at least one of a type, a number, a layout, and a connection state of the one or more of the devices (for example, the main devices) (e.g., the connection state of a propulsion device control signal line). With this arrangement, specific device information is accumulated in the server. Therefore, when a problem condition occurs, a proper test item can be acquired from the server.

For example, information about the type (model name), the number, and the connection state of the main devices is uploaded from the communication terminal to the server, and accumulated in the server, thus making it possible to speedily provide a proper test item for the problem condition of the main devices. The connection state information includes, for example, connection state information indicating whether a steering command line from the steering wheel is directly connected to the main device or connected to the main device via some other device (e.g., to one of the main devices via the other main devices where the plurality of main devices are provided).

In a preferred embodiment of the present invention, the server includes an operation master including model-specific operation master information that describes a condition and a test item for the condition for each of various types of devices that could possibly be mounted on each of the watercraft. The server searches the operation master based on the configuration information (e.g., the information about the type, the number, and the layout of the devices) and the condition data for the specific watercraft related to the test item request applied from the client terminal to specify the test item, and informs the client terminal about the specified test item.

With this arrangement, the server includes the operation master, and the model-specific operation master information describing the condition and the test item for each of the various types of devices is registered in the operation master. If the test item request for the specific watercraft is received from the client terminal, the server searches the operation master based on the watercraft configuration information about the specific watercraft such that reference is made to the model-specific operation master information about the devices provided in the specific watercraft. Further, the server finds a proper test item based on the condition data transmitted from the client terminal with reference to the model-specific operation master information related to the condition. The client terminal is informed about the test item thus found. Thus, the proper test item suitable for the configuration of the specific watercraft is dynamically generated by searching the operation master in which the model-specific operation master information for the various types of devices is registered. Thus, the operator can test the proper test item according to the configuration and the condition of the specific watercraft. This makes it possible to speedily recover from the problem condition without performing the useless test operation.

When a new product is supplied to the market, model-specific operation master information for the product may be registered in the operation master such that a watercraft mounted with the new product can be covered. That is, the watercraft troubleshooting support system can be configured to cover the new product by properly maintaining the operation master.

As described above, the watercraft significantly vary in configuration and, actually, it is no exaggeration to say that all watercraft have different configurations. Therefore, it is not realistic to prepare the operation master to cover the configurations of all the watercraft. If the operation master is prepared for typical configuration patterns, on the other hand, the operation master cannot cover the individual watercraft. There is a possibility that a proper test item cannot be generated, and a useless test operation is involved. Particularly, the test item and/or the test procedure are likely to have complicated options depending on the specific configuration of the watercraft. More specifically, the test item and the test procedure are likely to vary depending on the connection state of the command signal line to the main devices. Thus, it is not realistic to prepare the operation master to cover all the configuration patterns and, even if the operation master is prepared for some typical configuration patterns, the test item and the test procedure cannot be properly generated.

In a preferred embodiment of the present invention, in contrast, the test item is dynamically generated based on the watercraft configuration information and the model-specific operation master information thus solving the aforementioned problems.

In a preferred embodiment of the present invention, the model-specific operation master information includes abnormality scoring information that describes an abnormality score computation rule for computation of abnormality scores indicating the abnormality possibilities of the devices or other devices. The server computes abnormality scores of one or more of the devices based on the abnormality scoring information, and specifies one of the devices as a test object based on the computed abnormality scores, and determines the test item according to the model-specific operation master information for the device thus specified.

With this arrangement, a problem condition of a device (e.g., a specific device or its component) can be properly narrowed down based on the abnormality scoring information described in the model-specific operation master information. Specifically, the abnormality scores of candidates of the problem condition device are computed, and a device (or its component) having the highest abnormality score (most likely to suffer from the abnormality) is determined as the test object, and a test item for the device is determined.

In a preferred embodiment of the present invention, the abnormality score computation rule described in the abnormality scoring information is associated with at least one of the configuration information, the condition data transmitted from the client terminal, and a detection value of a sensor provided in the specific watercraft.

With this arrangement, the abnormality scores are properly computed. With the abnormality score computation rule associated with the configuration information, the scoring operation can be properly associated with the configuration of the watercraft. With the abnormality score computation rule associated with the condition data, the scoring operation can be properly associated with the problem condition. Further, with the abnormality score computation rule associated with the detection value of the sensor, the scoring operation can objectively reflect on the problem condition occurring in the specific watercraft.

The computation rule associated with the configuration information may include at least one of a computation rule based on the type of the device related to the condition or a computation rule based on a specific condition related to the problem condition (e.g., the connection state of the related device or the like).

The computation rule associated with the detection value of the sensor may include a determination condition to be compared with the detection value of the sensor associated with the condition. The determination condition may include a determination threshold, or may include a determination expression. The determination condition may be defined according to at least one of the condition or the device related to the condition. In the abnormality score computation rules for the model-specific operation master information about different models, for example, there may be a description such that reference should be made to the sensor value of the same sensor. In this case, however, the determination conditions for the abnormality score computation rules may differ from each other. Further, the determination conditions to be applied may be modified based on the configuration information. Thus, after understanding the situation of the watercraft and organizing the information, the operator does not need to modify the determination conditions according to the situation.

The detection value of the sensor may be transmitted from the communication terminal to the server. The communication terminal may periodically transmit the detection value of the sensor to the server. Further, the communication terminal may transmit the detection value of the sensor to the server in response to a request applied by the server. Further, the communication terminal may transmit the detection value of the sensor together with the configuration information to the server, or may transmit the detection value of the sensor separately from the configuration information to the server.

In a preferred embodiment of the present invention, the server is configured or programmed to receive information about the test result of the test item (e.g., a condition, a sensor value and the like), generate a test item to be next tested based on the received information, and transmit the next test item to the client terminal.

With this arrangement, where the abnormality causing device cannot be determined by testing the first test item, the server can generate another test item in consideration of the test result of the first test item. Thus, the test procedure can be properly performed according to the configuration and the actual situation of the watercraft for troubleshooting. Thus, the troubleshooting can be speedily performed for recovery from the problem condition.

The test result of the test item may be at least partially transmitted from the communication terminal to the server (e.g., the detection value of the sensor may be transmitted from the communication terminal to the server). Further, the test result of the test item may be at least partially transmitted from the client terminal to the server (e.g., a condition observed when the test item is tested may be transmitted from the client terminal to the server).

In a preferred embodiment of the present invention, the communication terminal is configured or programmed to transmit at least one of failure information about a failure occurring in the specific watercraft or the detection value of the sensor provided in the specific watercraft to the server.

With this arrangement, information objectively indicating the state of the watercraft is supplied in addition to the watercraft configuration information to the server. Therefore, the server can more properly generate the test item, and apply the test item to the client terminal. In addition, the operator does not need to transmit information, but information about a component number or the like can be accurately transmitted to the server, and the problem information (failure information) can also be transmitted to the server and recorded in the server.

In a preferred embodiment of the present invention, the communication terminal is configured or programmed to spontaneously transmit information collected in the specific watercraft to the server, or transmit the information collected in the specific watercraft to the server in response to a request from the server.

With this arrangement, the configuration information and the like can be uploaded to the server and accumulated in the server by the spontaneous transmission function or the responsive transmission function. Further, when the test item is tested, the server can request the communication terminal to transmit the information by the responsive transmission function, for example, in response to a request from the client terminal. Thus, the detection value of the sensor for the test item, for example, can be uploaded from the communication terminal to the server. The uploaded detection value may be used for the determination in the server, or may be transmitted to the client terminal and used for the determination by the operator.

In a preferred embodiment of the present invention, the client terminal is configured or programmed to transmit information about the test result of the test item specified by the server to the server. The client terminal may include an input to which at least one of the condition or the test result of the test item is inputted, and may be configured or programmed to transmit the information inputted from the input to the server.

Another preferred embodiment of the present invention provides a server for use in the watercraft troubleshooting support system including any of the aforementioned features.

Another further preferred embodiment of the present invention provides a communication terminal for use in the watercraft troubleshooting support system including any of the aforementioned features.

Still another preferred embodiment of the present invention provides a client terminal for use in the watercraft troubleshooting support system including any of the aforementioned features.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 4 shows an exemplary operation master provided in the server.

FIG. 9 shows abnormality scoring and test items by way of example.

DETAILED DESCRIPTION OF THE PREFERRED EMBODIMENTS

Figure 1:
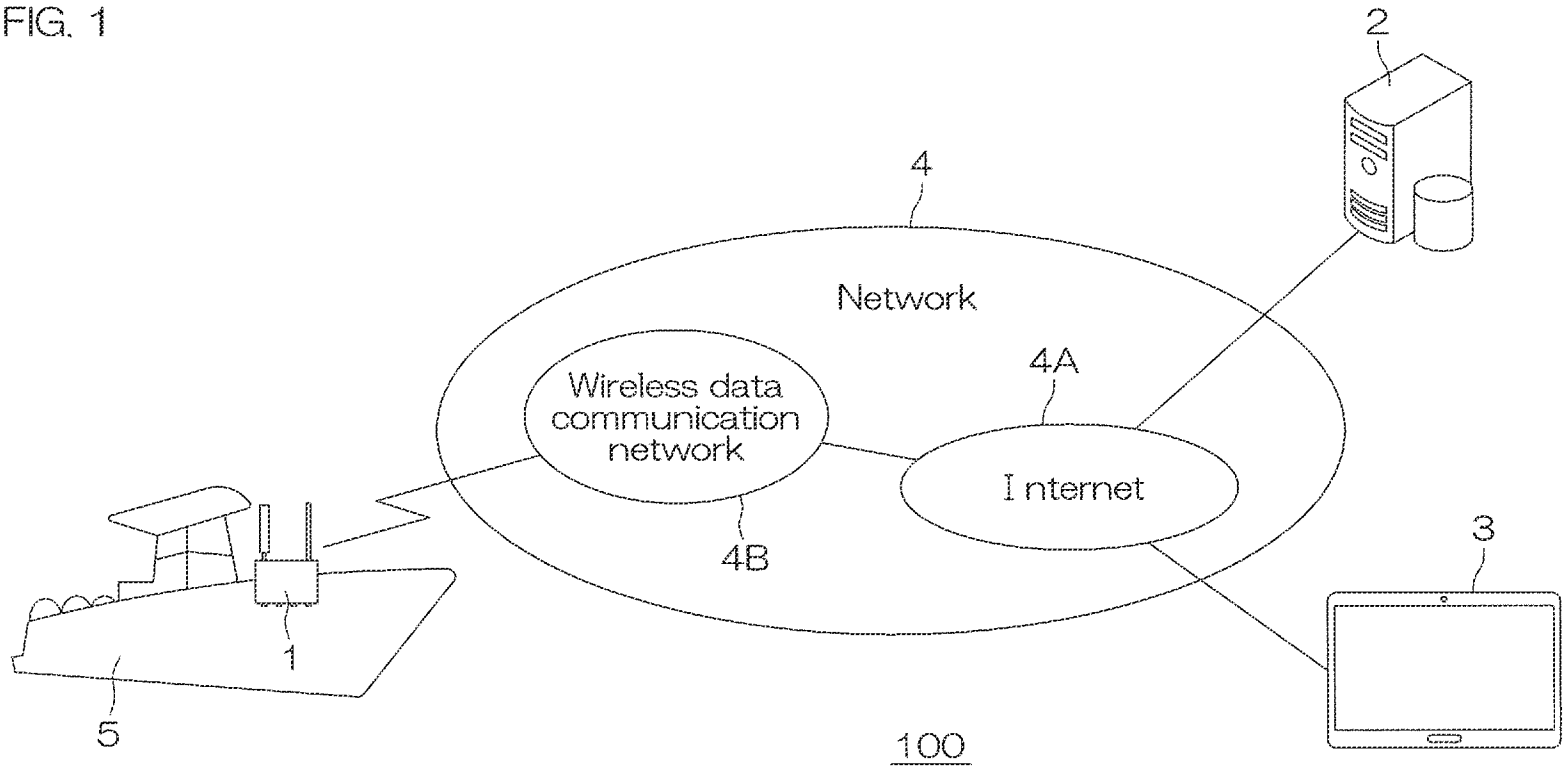
FIG. 1 is a schematic diagram of a watercraft troubleshooting support system according to a preferred embodiment of the present invention.

FIG. 1 is a schematic diagram of a watercraft troubleshooting support system according to a preferred embodiment of the present invention. The watercraft troubleshooting support system 100 includes a communication terminal 1 that collects and transmits information about devices provided on or in a watercraft 5, a server 2 that receives and accumulates the information transmitted from the communication terminal 1, and a client terminal 3 that communicates with the server 2. The communication terminal 1 may be provided in or on the watercraft 5. Further, the communication terminal 1 may be portable so that a crew member can bring the communication terminal 1 into or onto the watercraft 5 as required.

The communication terminal 1 and the server 2 can communicate with each other via a network 4. That is, the communication terminal 1 and the server 2 are each connected to the network 4 in a communicable manner. The network 4 typically includes an internet 4A. The communication terminal 1 is connected to a wireless data communication network 4B such as a mobile phone network in a communicable manner, and is connected to the internet 4A via the wireless data communication network 4B in a communicable manner.

The client terminal 3 may be provided in a dealer office and/or a marina office (hereinafter referred to as "client terminal 3").

The client terminal 3 may be configured to be connectable to the internet 4A via a local area network (not shown) provided in the office, or may be configured to be connectable to the internet 4A via the wireless data communication network 4B. Typically, where the client terminal 3 is used in the dealer office or the marina office, the client terminal 3 is preferably configured to be connectable to the internet 4A via the local area network. Further, where the client terminal 3 is used by an operator at a remote location at which the watercraft 5 is present, the client terminal 3 is preferably configured to be connectable to the internet 4A via the wireless data communication network 4B. Further, the client terminal 3 may be configured to be connectable to the network 4 via the communication terminal 1.

Figure 2:
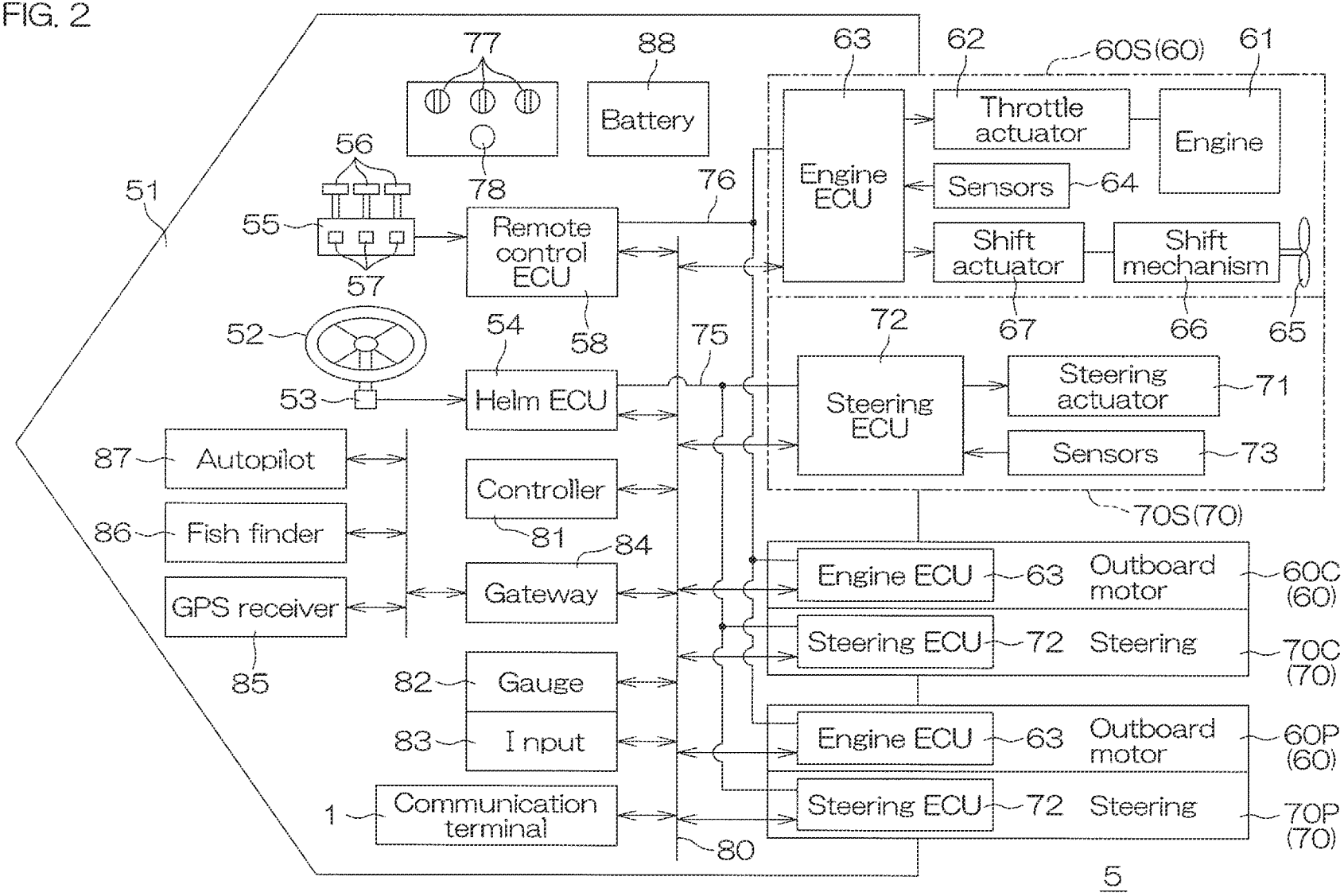
FIG. 2 is a block diagram showing a configuration of a watercraft by way of example.

FIG. 2 is a block diagram showing the configuration of the watercraft 5 by way of example. The watercraft 5 includes a hull 51, and various devices provided in the hull 51 (watercraft devices or rigging devices). The watercraft devices typically include an input device to maneuver the watercraft (watercraft maneuvering device), a controller 81 that comprehensively controls the devices provided on the watercraft 5, a propulsion device that applies a propulsive force to the hull 51, and a steering device (watercraft maneuvering device) that changes the advancing direction of the hull 51.

In this example, the input device includes a steering wheel 52 and a remote controller 55.

In a preferred embodiment of the present invention, the propulsion device includes an outboard motor 60 as the main device (main propulsion device). Specifically, the outboard motor 60 includes one or more outboard motors 60 provided on the stern of the hull 51. In this example, a plurality of outboard motors 60 (more specifically, three outboard motors 60) are disposed side by side and attached to the stern. In this example, the outboard motors 60 are engine outboard motors each including an engine 61 (internal combustion engine) as a power source to drive a propeller 65. Of course, electric outboard motors each including an electric motor as a power source may be used instead. For discrimination among these three outboard motors 60, a middle one of the outboard motors 60 is referred to as "middle outboard motor 60C" and the other two outboard motors 60 located on the left side and the right side of the middle outboard motor 60C are respectively referred to as "port-side outboard motor 60P" and "starboard-side outboard motor 60*s*."

In a preferred embodiment of the present invention, the steering device includes steering units 70 that respectively steer the outboard motors 60 leftward and rightward. The steering units 70 are provided in one-to-one correspondence with the outboard motors 60. In this example, three steering units 70 are provided. For discrimination among the three steering units 70 respectively corresponding to the middle outboard motor 60C, the port-side outboard motor 60P and the starboard-side outboard motor 60S, these steering units 70 are referred to as "middle steering unit 70C," "port-side steering unit 70P" and "starboard-side steering unit 70S."

The steering wheel 52 is turned by a watercraft operator. The operation angle of the steering wheel 52 is detected by an operation angle sensor 53, and inputted to a helm ECU (Electronic Control Unit) 54. The remote controller 55 includes acceleration levers 56 to be operated by the watercraft operator to adjust the directions (forward or reverse directions) and the magnitudes of propulsive forces to be generated by the respective outboard motors 60. The operation positions of the acceleration levers 56 are respectively detected by acceleration position sensors 57, and inputted to a remote control ECU 58.

The outboard motors 60 each include the engine 61, the propeller 65 that is driven by the engine 61, a shift mechanism 66, and an engine ECU 63. The shift mechanism 66 has a plurality of shift positions, i.e., a forward shift position, a reverse shift position, and a neutral shift position. With the shift position set to the forward shift position, the propeller 65 is rotated in a forward rotation direction by the driving force of the engine 61. With the shift position set to the reverse shift position, the propeller 65 is rotated in a reverse rotation direction by the driving force of the engine 61. With the shift position set to the neutral shift position, power transmission between the engine 61 and the propeller 65 is cut off. The engine ECU 63 controls the operation of a shift actuator 67 that actuates the shift mechanism 66 to control the direction of the propulsive force. Further, the engine ECU 63 controls the operation of a throttle actuator 62 that drives the throttle valve of the engine 61 to control the magnitude of the propulsive force.

The steering units 70 each include a steering actuator 71 and a steering ECU 72 that controls the steering actuator 71. The steering actuator 71 generates power to pivot the corresponding outboard motor 60 leftward and rightward about its steering shaft (not shown). Thus, the direction of the propulsive force applied to the hull 51 by the outboard motor 60 is changed leftward and rightward such that the advancing direction of the watercraft 5 is changed. The steering unit 70 may be unitary with the corresponding outboard motor 60, or may be separate from the outboard motor 60. In FIG. 2, the steering unit 70 and the outboard motor 60 are configured as a unitary unit by way of example (e.g., the steering unit 70 is incorporated in the outboard motor 60).

The helm ECU 54 is connected to the steering ECUs 72 via a steering command line 75. As shown, the steering command line 75 may directly connect the helm ECU 54 to all the steering units 70. Further, the steering command line 75 may directly connect the helm ECU 54 to the steering ECU 72 of the port-side steering unit 70P and/or the steering ECU 72 of the starboard-side steering unit 70S, but the steering ECU 72 of the middle steering unit 70C does not need to be directly connected to the helm ECU 54. That is, the steering command line 75 may be configured so that the steering ECU 72 of the middle steering unit 70C is connected to the helm ECU 54 indirectly via the steering ECU 72 of the port-side steering unit 70P and/or the steering ECU 72 of the starboard-side steering unit 70S. The steering command line 75 transmits a steering command signal generated by the helm ECU 54. The steering command signal is applied to command the steering directions and the steering angles of the outboard motors 60 as corresponding to the operation direction (turning direction) and the operation angle of the steering wheel 52.

The remote control ECU 58 is connected to the engine ECUs 63 via an output command line 76. In a preferred embodiment of the present invention, the output command line 76 directly connects the remote control ECU 58 to the engine ECUs 63 of all the outboard motors 60. Alternatively, like the steering command line 75, the output command line 76 may connect the engine ECU 63 of the middle outboard motor 60C to the remote control ECU 58 via the engine ECU 63 of the port-side outboard motor 60P and/or the engine ECU 63 of the starboard-side outboard motor 60S. The output command line 76 transmits an output command generated by the remote control ECU 58. The output command is applied to command the directions and the magnitudes of the propulsive forces of the respective outboard motors 60.

A data communication network, i.e., an onboard LAN (Local Area Network) 80, is provided in or on the watercraft. The controller 81 is connected to the onboard LAN 80. Further, the helm ECU 54, the remote control ECU 58, the steering ECUs 72, and the engine ECUs 63 are each connected to the onboard LAN 80.

The controller 81 can acquire information about the steering command from the helm ECU 54, and can acquire information about the output command from the remote control ECU 58.

The controller 81 can acquire various information from the steering ECU 72 of each of the steering units 70. For example, the controller 81 can acquire the information about the steering command received by the steering ECU 72, and information about detection results obtained by various sensors 73 provided in the steering unit 70. The sensors 73 include, for example, a steering angle sensor. The steering angle sensor detects the actual steering angle of the outboard motor 60. The steering angle sensor may be configured to detect the operation amount of the steering actuator 71.

Further, the controller 81 can acquire various information from the engine ECU 63 of each of the outboard motors 60. For example, the controller 81 can acquire the information about the output command received by the engine ECU 63, and information about detection results obtained by various sensors 64 provided in the outboard motor 60. The sensors 64 include, for example, a throttle opening degree sensor, an engine rotation speed sensor, and an engine temperature sensor. The throttle opening degree sensor is able to detect the opening degree of the throttle valve of the engine 61. The engine rotation speed sensor is able to detect the rotation speed of the engine 61, and may be a crank angle sensor. The engine ECU 63 may be able to process the output of the crank angle sensor to generate engine rotation speed information. The engine temperature sensor may be able to detect the temperature of the cylinder block of the engine 61 (e.g., the temperature of cooling water), or may be able to detect the exhaust temperature of the engine 61.

A gauge 82 that displays various information is connected to the onboard LAN 80. Further, the communication terminal 1 is connected to the onboard LAN 80. The communication terminal 1 is configured to transmit information about the situation of the watercraft 5 and the like to the server 2 (see FIG. 1). More specifically, the communication terminal 1 is configured to transmit watercraft configuration information indicating the configuration of the watercraft 5, failure information indicating a failure occurring in the watercraft 5, the detection values of the sensors and the like to the server 2.

The gauge 82 functions, for example, as a display device to display a residual fuel amount, the engine rotation speeds and the shift positions of the respective outboard motors 60, a residual battery capacity, and the like. The residual battery capacity is the residual capacity of a battery 88 mounted on the hull 51 to actuate starter motors (not shown) incorporated in the respective outboard motors 60 to start the engine. The battery 88 discharges to start the engine, and is charged by power generators (not shown) incorporated in the respective outboard motors 60 during the operation of the engines. The gauge 82 may include an input device 83 such as input buttons and a touch panel. The input device 83 may be operated by the watercraft operator to input various commands. The input device 83 may be provided separately from the gauge 82.

Additionally, various watercraft devices may be connected to the onboard LAN 80 in a data communicable manner. A third party's watercraft devices (e.g., aftermarket devices) are typically connected to the onboard LAN 80 via a gateway 84. In FIG. 2, a GPS (Global Positioning System) receiver 85, a fish finder 86, and an autopilot device 87 are illustrated as examples of the third party's watercraft devices.

The steering wheel 52 and the remote controller 55 are disposed in association with a helm seat, and main switches 77 to be operated to turn on and off power supply to the respective outboard motors 60 and to start and stop the engines 61 of the respective outboard motors 60 are also disposed in association with the helm seat. A kill switch 78 (emergency stop switch) to be operated to nullify the propulsive forces of the outboard motors 60 (typically to stop the engines 61) in an emergency is provided in association with the helm seat. The kill switch 78 includes, for example, an operation end to which a lanyard cable carried by the watercraft operator is connected. When the watercraft operator falls overboard, the kill switch 78 is actuated for the emergency stop of the engines 61 of the outboard motors 60.

Figure 3:
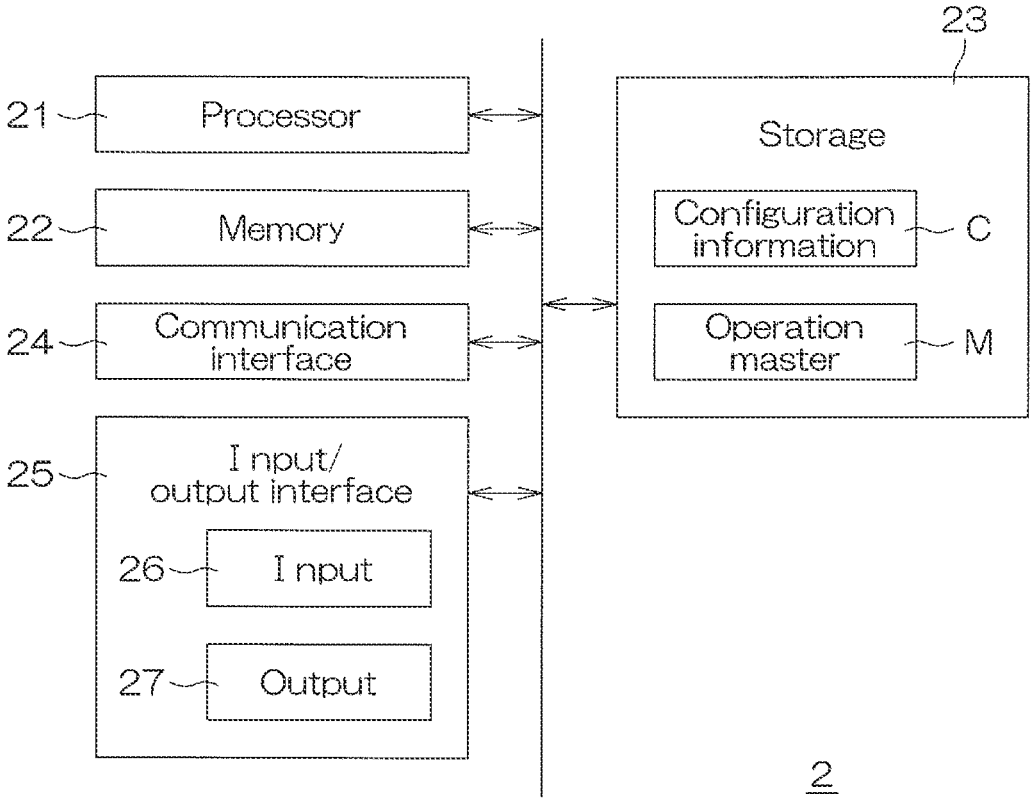
FIG. 3 is a block diagram showing a configuration of a server by way of example.

FIG. 3 is a block diagram showing the configuration of the server 2 by way of example. The server 2 has a basic configuration as a computer. That is, the server 2 includes a processor 21, a memory 22, a storage 23, a communication interface 24, and an input/output interface 25, which are connected to each other in a data communicable manner in the server 2.

The processor 21 executes a program stored in the memory 22 to perform various functions. Specifically, the server 2 includes the function of communicating with the communication terminal 1 (see FIG. 1), collecting data from the communication terminal 1, and accumulating the data in the storage 23. The server 2 includes the function of generating test items to be tested for testing the watercraft 5 based on the accumulated information. Further, the server 2 includes the function of communicating with the client terminal 3 (see FIG. 1), providing a web page to the client terminal 3, and providing a web application service on the web page. In order to provide the web application service, a web application program is stored in the memory 22. The storage 23 provides a storage area for the accumulation of the data. The communication interface 24 interfaces with the network 4 for communications. The input/output interface 25 includes an input device 26 (e.g., a keyboard) and an output device 27 (e.g., a display device) to provide a man-machine interface.

For a plurality of watercraft, configuration information C indicating the configuration of each individual watercraft is accumulated in the storage 23. The configuration information C to be accumulated in the storage 23 includes configuration information transmitted from the communication terminal 1 of the each individual watercraft 5. The configuration information C to be accumulated in the storage 23 includes not only the information uploaded from the communication terminal 1 but also configuration information registered by a dealer, a user or the like by accessing the server 2 via the network 4.

The configuration information C about the each individual watercraft 5 includes information about one or more devices provided on the watercraft 5. The devices herein include the hull 51, and the watercraft devices provided in the hull 51. The configuration information about the hull 51 may be information that specifies, for example, the configuration of the hull 51 (a hull bottom shape or the like). Specifically, the hull configuration information may be the model name of the hull 51. The configuration information about the watercraft devices may include information indicating the types of the watercraft devices, i.e., the model names of the watercraft devices. The configuration information C may further include at least one (preferably all) of the number, the layout, and the connection state of the watercraft devices. Particularly, the configuration information C preferably includes information about the types (model names), the numbers, the layouts, and the connection states of the outboard motors 60 as the main device, and the steering units 70 incorporated in the respective outboard motors 60. The connection states may be, for example, the connection states of the steering command line 75 and the output command line 76.

An operation master M to be used for the generation of the test items for each individual watercraft 5 is stored in the storage 23. The processor 21 functions to dynamically generate the test items according to the configuration and the condition of the each individual watercraft 5 with reference to the configuration information C and the operation master M.

FIG. 4 shows an example of the operation master M. The operation master M includes a set of model-specific operation master information that defines test operations to be performed for different models of devices of the watercraft. As described above, the devices herein include the hull, and the watercraft devices provided in the hull. The model-specific operation master information is prepared for various devices possibly included in the watercraft, and is preliminarily registered in the storage 23. If a new product for the watercraft is put into the market, model-specific operation master information for the new product is additionally registered.

The model-specific operation master information includes the model name of the device, component information about components of the device of the model, and individual operation information. The individual operation information includes an object component name indicating the name of an operation object component, the problem condition of the operation object component, sensor values related to the operation object component, abnormality scoring information, recovery operation information and the like. The abnormality scoring information defines a computation rule for computation of abnormality scores (index values for abnormality determination) according to the problem condition, the sensor values, and specific conditions. The recovery operation information indicates a test item to be tested when the operation object component is probably an abnormality causing part. As required, the operation master information may be edited at any time.

For example, the model-specific operation master information is prepared for each of a plurality of models of outboard motors (examples of the main device (main propulsion device)) provided by a certain manufacturer, and stored in the storage 23 of the server 2. In model-specific operation master information for one model of outboard motor, the model name of the outboard motor is described, and "With built-in electric steering unit" is, for example, described as component information for the outboard motor model. Further, individual operation information for the electric steering unit as a component of the outboard motor is described. That is, the outboard motor model is such that the electric steering unit is built in the outboard motor. In the individual operation information, for example, "Electric steering unit" is described as the component name of the operation object component, and "Steering inoperable" is described as the problem condition. Further, "Input command value, steering electric current value and actual steering angle" is described as relevant sensor value information.

An example of the abnormality scoring information is defined such that, when a steering error is detected, the abnormality score is increased by +10. This indicates that, when the steering inoperable condition is inputted, a score (abnormality score) for the abnormality possibility of the electric steering unit should be increased by +10. This is an example of a computation rule associated with the condition, and an example of a computation rule based on the type of device related to the condition. Another example of the abnormality scoring information is defined such that, when a difference between the operation amount and the output amount is greater than 30%, the abnormality score is increased by +5. This is an example of a computation rule associated with the sensor detection value, and indicates that, when a difference between an input command value (which is the operation angle of the steering wheel (the detection value of the operation angle sensor 53)) and the actual steering angle detected by the steering angle sensor is greater than 30% (an example of the determination threshold) (an example of the determination condition), the abnormality score for the electric steering unit should be increased by +5. The determination condition may be defined as a numerical expression (determination expression).

For example, "When steering error is detected at middle position, abnormality score for port-side position is increased by +5" is defined as the specific condition. This indicates that, when the steering inoperable condition is inputted for a middle outboard motor out of a port-side outboard motor, the middle outboard motor and a starboard-side outboard motor provided in a watercraft, the abnormality score for an electric steering unit for the port-side outboard motor should be increased by +5. This corresponds to the description of an abnormality score computation rule for a device (e.g., the port-side outboard motor) other than the device of interest (e.g., the middle outboard motor). However, a precondition required for the abnormality scoring under this specific condition is that the steering command line 75 is not directly connected between the helm ECU 54 and the middle steering unit 70C, and the steering command is applied to the middle steering unit 70C from the helm ECU 54 via the port-side steering unit 70P (see FIG. 2). This is an example of a computation rule associated with the configuration information (particularly, connection state information), and is an example of a computation rule based on a specific precondition associated with the problem condition.

In this example, test items described for a recovery operation are a supply voltage of not less than 14 V and the continuity of the communication line (the steering command line) between the steering units.

The determination condition to be applied may be modified based on the configuration information. For example, even the same model of outboard motor may include a single fuel pump or two fuel pumps. An outboard motor including a single fuel pump and an outboard motor including two fuel pumps experience different loads at the startup and, therefore, have correspondingly different electric designs. Where the engine start of the outboard motor is impossible, therefore, a test item to be tested is the supply voltage, but a threshold for the supply voltage varies depending on the number of the fuel pumps. Therefore, the threshold for the determination condition is modified according to the configuration information (the number of the fuel pumps). This provides proper abnormality scoring.

Figure 5:
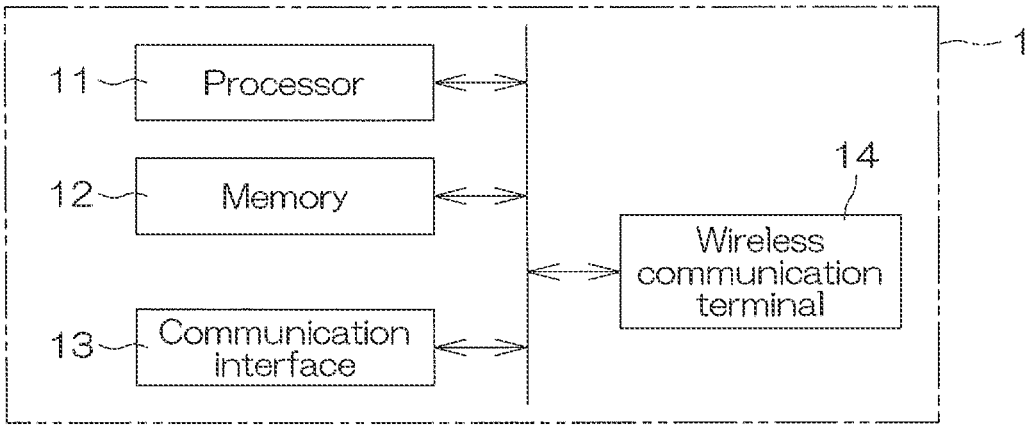
FIG. 5 is a block diagram showing a configuration of a communication terminal by way of example.

FIG. 5 is a block diagram showing the configuration of the communication terminal 1 by way of example. The communication terminal 1 includes a processor 11, a memory 12, a communication interface 13, and a wireless communication terminal 14. The processor 11 operates according to a program stored in the memory 12 to perform a plurality of functions. The communication interface 13 serves for data communications via the onboard LAN 80. The wireless communication terminal 14 serves for wireless transmission of data to the server 2 via the network 4.

The processor 11 performs a data collecting function to collect information from the devices provided in the hull 51 via the onboard LAN 80 and store the information in the memory 12. The information to be collected include configuration information including the names, the numbers, and the connection states of the devices provided in the hull 51. Further, the information to be collected includes the detection values of the various sensors. Specifically, the detection values of the sensors 53, 57, 64, 73 connected to the helm ECU 54, the remote control ECU 58, the steering ECUs 72, and the engine ECUs 63 can be collected. The information to be collected may further include information generated by the helm ECU 54, the remote control ECU 58, the steering ECUs 72, and the engine ECUs 63. Such information may include control information (control commands and other data) generated in the respective ECUs, and problem information detected by the respective ECUs. As described above, the main switches 77, the kill switch 78, the start switch, and other switches are regarded as sensors, and the states of these switches are collected as detection values. Further, the processor 11 may include a problem detecting function to monitor the states of the various devices connected to the onboard LAN 80 and generate problem information (failure information). For example, the processor 11 may monitor the states of the respective ECUs and detect operation interruption due to an instantaneous drop of the supply voltage as a problem (instantaneous power outage). The collected information and the generated problem information and the like are stored in the memory 12. There is no need to collect the information from all the devices connected to the onboard LAN 80. For example, information from the third party's devices connected via the gateway 84 may be excluded.

The processor 11 functions to cause the wireless communication terminal 14 to transmit all or a portion of the information collected and/or generated by itself and stored in the memory 12 to the server 2. In this preferred embodiment, there are two transmission modes, i.e., a periodic transmission mode and a high-speed transmission mode.

The periodic transmission mode is a normal transmission mode (an example of the spontaneous transmission function) in which information is spontaneously transmitted to the server 2 in a periodic transmission cycle. The periodic transmission cycle may be, for example, about 10 minutes. The information to be transmitted in the periodic transmission mode may be limited to predefined periodic transmission information out of the information stored in the memory 12. Particularly important information such as the problem information (failure information) is preferably included in the periodic transmission information. The periodic transmission information is uploaded and accumulated in the server 2, and is mainly used to thereafter check the occurrence of the abnormalities, the situations of the watercraft during the occurrence of the abnormalities, and the like.

As described above, the communication terminal 1 collects the configuration information about the watercraft 5. The configuration information may also be included in the periodic transmission information. When the configuration information is altered, for example, the altered configuration information may be included in the periodic transmission information, which is in turn uploaded to the server 2 to update the configuration information accumulated in the server 2. The latest configuration information may be transmitted from the communication terminal 1 to the server 2 whenever the configuration information is altered, rather than being included in the periodic transmission information (an example of the spontaneous transmission function).

The high-speed transmission mode is an occasional transmission mode in which information is transmitted to the server 2 in a high-speed transmission cycle that is shorter than the periodic transmission cycle. The transmission function in the high-speed transmission mode is an example of the responsive transmission function of transmitting information in response to a request from the server 2. The high-speed transmission cycle may be, for example, about 1 second. The amount of the information to be transmitted in the high-speed transmission mode is preferably greater than the amount of the information to be transmitted in the periodic transmission mode. Specifically, information useful for troubleshooting (e.g., information requested by the server 2) is preferably transmitted to the server 2 as much as possible in addition to the periodic transmission information. The information uploaded to the server 2 in the high-speed transmission mode is mainly used to check the situation of the watercraft 5 in real time.

Figure 6:
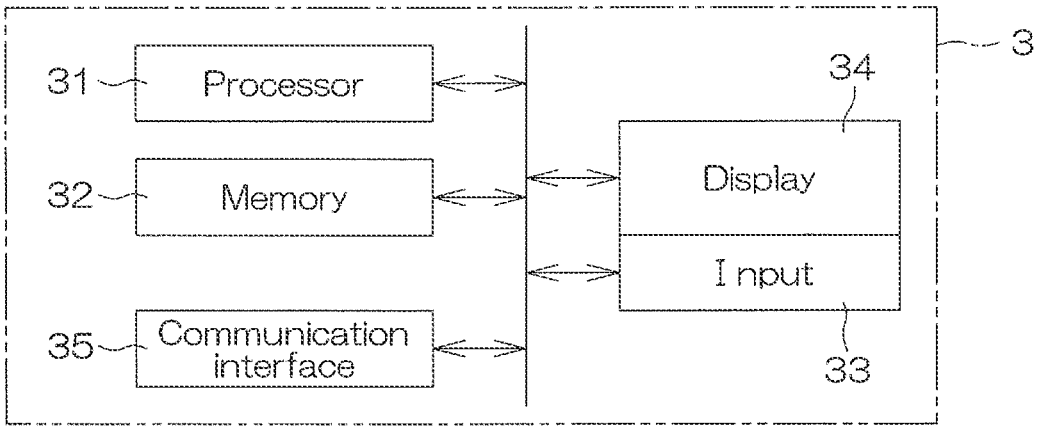
FIG. 6 is a block diagram showing a configuration of a client terminal by way of example.

FIG. 6 is a block diagram showing the configuration of the client terminal 3 by way of example. The client terminal 3 has a basic configuration as a computer. For example, the client terminal 3 may be a personal computer of the clamshell type or tablet type.

The client terminal 3 includes a processor 31, a memory 32, an input device 33, a display device 34, and a communication interface 35. The processor 31 executes a program stored in the memory 32 to perform various functions. The input device 33 may be a touch panel provided on the display screen of the display device 34. The communication interface 35 interfaces with the network 4 for data communications. The communication interface 35 may communicate with the network 4 (see FIG. 1) via a local area network (not shown) provided in a dealer office, a marina office or the like through cable or wireless data communications. Further, the communication interface 35 may be configured to be connectable to the wireless data communication network 4B (see FIG. 1). Further, the communication interface 35 may be communicable with the communication terminal 1, or may be connectable to the network 4 via the communication terminal 1.

In the memory 32, at least a web browser program is stored. The processor 31 executes the web browser program such that the user of the client terminal 3 (dealer staff, marina staff or the like) can browse the web page provided by the server 2 to utilize the web application service provided on the web page.

The user of the client terminal 3 can display the web page on the display device 34. On the web page thus displayed, the user can input a condition occurring in a customer's watercraft 5 to transmit condition data to the server 2, and can request the server 2 to provide a test item. On the displayed web page, the user of the client terminal 3 can further request the server 2 to troubleshoot the customer's watercraft 5.

Figure 7:
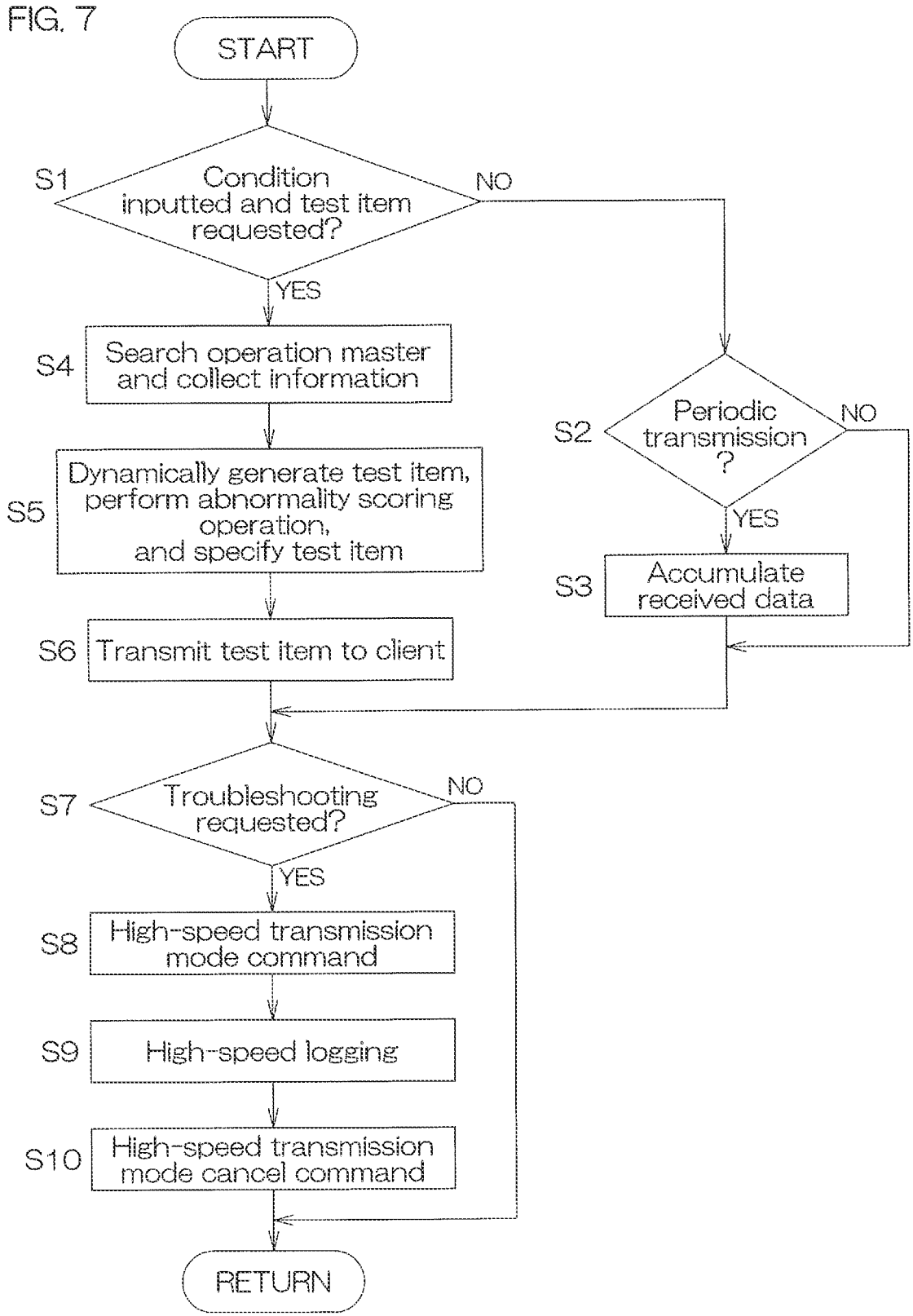
FIG. 7 is a flowchart for describing an exemplary process to be performed in the server.

FIG. 7 is a flowchart for describing an exemplary process to be performed in the server 2. In a normal state in which neither condition data nor a test item request is received from the client terminal 3 (NO in Step S1), the server 2 performs a normal logging operation to receive information transmitted from the communication terminal 1 in the periodic transmission cycle, and accumulates the received information in the storage 23 (Steps S2 and S3). Thus, configuration information about each individual watercraft 5, sensor value data, problem information (failure information) and the like are accumulated in the storage 23.

If condition data and a test item request for a specific watercraft 5 are transmitted from the client terminal 3 (YES in Step S1), the server 2 searches the operation master M based on the configuration information C accumulated in the storage 23 and the information (the condition data) inputted from the client terminal 3. Thus, the server 2 collects relevant information (Step S4), dynamically generates a test item (recovery operation procedure) (Step S5), and transmits the generated test item to the client terminal 3 (Step S6). Specifically, the test item is inputted on the web page displayable on the client terminal 3.

More specifically, the server 2 searches the operation master M based on the configuration information C about the specific watercraft 5 accumulated in the storage 23 and the inputted condition data to collect model-specific operation master information for a model related to the problem condition. Further, the server 2 performs the abnormality scoring operation based on the individual operation information of the collected model-specific operation master information with reference to the abnormality scoring information for the problem condition. The abnormality scoring operation is performed to compute abnormality scores for operation object components probably suffering from abnormalities according to the abnormality scoring information. The priority order of the operation object components is determined by ranking the operation object components based on the abnormality scores computed by the abnormality scoring operation. The server 2 refers to recovery operation information for an operation object component ranked at the highest priority, and displays the recovery operation information as the test item on the web page on the client terminal 3.

Thus, the user of the client terminal 3 can acquire information about the test item. The client terminal 3 can specify the watercraft 5 and the test item, and transmit a troubleshooting request to the server 2 in order to test the test item. Upon reception of the troubleshooting request (YES in Step S7), the server 2 transmits a high-speed transmission mode command to the communication terminal 1 of the specific watercraft 5 to command the transmission of the detection value of the sensor related to the specified test item (Step S8). Thus, the transmission mode of the communication terminal 1 is switched to the high-speed transmission mode so that the communication terminal 1 can transmit the detection value of the sensor to the server 2 in the high-speed transmission cycle.

The server 2 performs a high-speed logging operation to receive the information transmitted from the communication terminal 1 in the high-speed transmission cycle, and accumulates the information in the storage 23 (Step S9). After receiving necessary information, the server 2 may transmit a high-speed transmission mode cancel command to the communication terminal 1 (Step S10). Upon reception of the high-speed transmission mode cancel command, the communication terminal 1 switches its transmission mode to the periodic transmission mode. Thus, the server 2 acquires the sensor value in real time.

Figure 8:
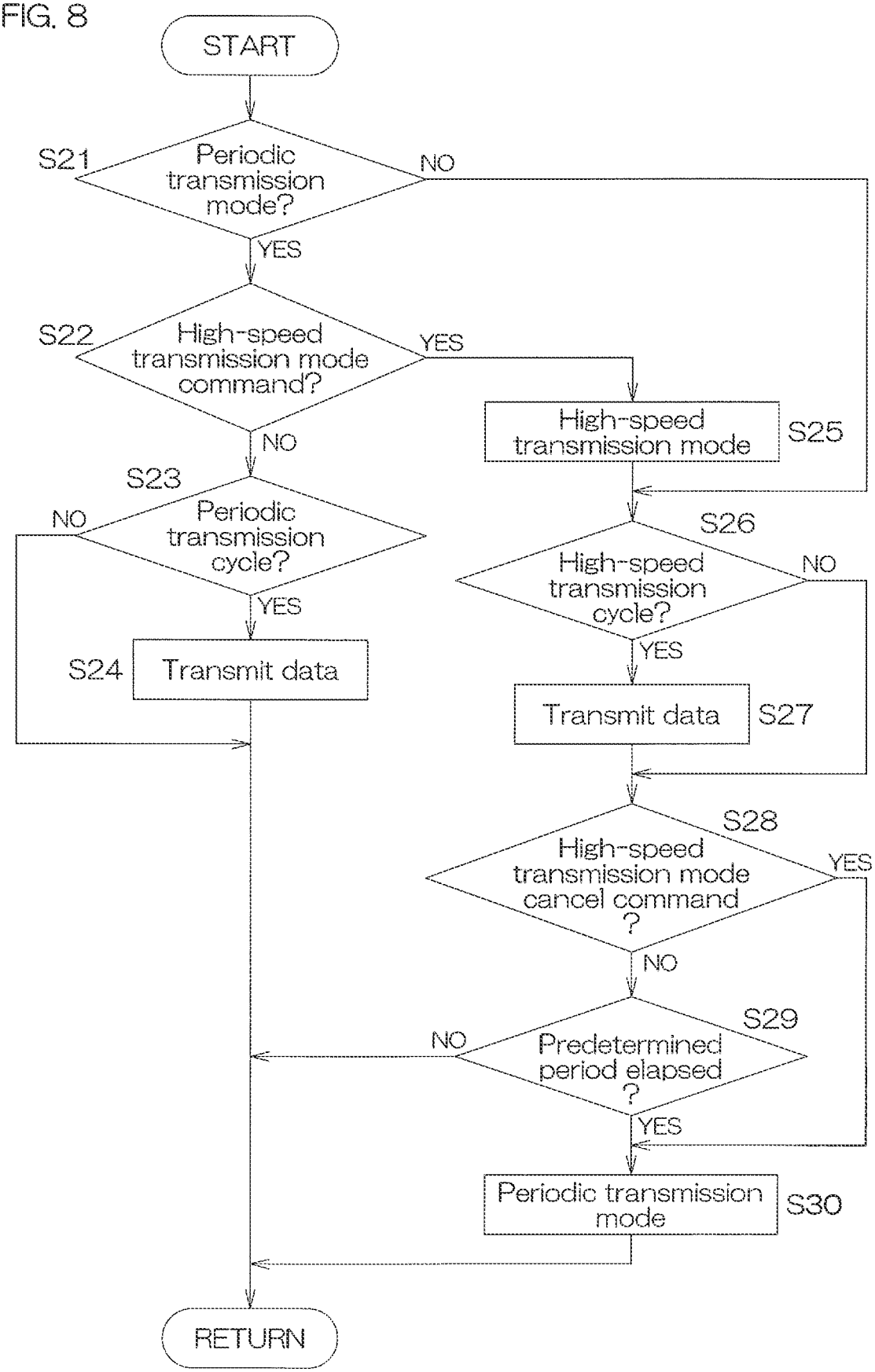
FIG. 8 is a flowchart for describing an exemplary process to be performed in the communication terminal.

FIG. 8 is a flowchart for describing an exemplary process to be performed in the communication terminal 1. The default transmission mode of the communication terminal 1 is the periodic transmission mode (YES in Step S21). In the normal state without the input of the high-speed transmission mode command (NO in Step S22), the communication terminal 1 operates in the periodic transmission mode to perform a periodic transmission operation. That is, in every periodic transmission cycle (YES in Step S23), the communication terminal 1 transmits predetermined periodic transmission information (Step S24). If the high-speed transmission mode command is inputted (YES in Step S22), the communication terminal 1 switches its transmission mode to the high-speed transmission mode (Step S25) to perform a high-speed transmission operation. That is, in every high-speed transmission cycle (YES in Step S26), the communication terminal 1 transmits predetermined high-speed transmission information (Step S27). The high-speed transmission information includes information different from the periodic transmission information. Typically, the high-speed transmission information includes information to be transmitted as commanded by the server 2. After a lapse of a period predetermined in consideration of time required for transmission of necessary information (YES in Step S29) or if the high-speed transmission mode cancel command is received (YES in Step S28), the communication terminal 1 cancels the high-speed transmission mode, and switches its transmission mode to the periodic transmission mode (Step S30).

The high-speed transmission mode command may be applied to the communication terminal 1 by operating the input device 83 (see FIG. 2) provided in the watercraft 5, rather than being transmitted from the server 2 to the communication terminal 1. Where the client terminal 3 is connected to the communication terminal 1 in a communicable manner, the high-speed transmission mode command may be applied from the client terminal 3 to the communication terminal 1. The high-speed transmission mode cancel command may also be applied in the same manner. Where the communication terminal 1 is configured to cancel the high-speed transmission mode after a lapse of the predetermined period, as described above, the high-speed transmission mode cancel command may be obviated.

FIG. 9 shows the abnormality scoring and test item information provided based on the abnormality scoring by way of example. In this example, information about the inoperable condition of the middle steering unit is provided as the condition data from the client terminal 3 to the server 2, and the configuration information about the specific watercraft stored in the storage 23 of the server 2 includes a description such that the watercraft includes three outboard motors. Further, inconsistency between the steering operation amount and the steering output as indicated by the detection values of the sensors acquired from the communication terminal of the watercraft is recorded in the storage 23. This information is also regarded as the condition data.

The server 2 performs the abnormality scoring operation by searching the operation master M based on the condition data and the configuration information. In this example, the result is that the middle steering unit has the highest abnormality score (i.e., 15), followed by the port-side steering unit, the helm unit (steering wheel), and the remote control unit, which are smaller in abnormality score in this order. Therefore, the middle steering unit is the operation object component ranked at the highest priority. As test items to be checked in the recovery operation, the supply voltage and the continuity of the communication line between the steering units are displayed on the client terminal 3.

An operator (e.g., dealer staff or marina staff) acquires the aforementioned information on the screen of the client terminal 3, and performs a test operation according to the information. The operator is dispatched to the watercraft 5, and performs the test operation with the use of a test device. Additionally, as described above, the test operation may be performed by transmitting the troubleshooting request from the client terminal 3 to the server 2. In this case, the server 2 requests the communication terminal 1 of the watercraft 5 to transmit the detection value of the corresponding sensor, and applies the high-speed transmission mode command to the communication terminal 1. In response to the high-speed transmission mode command, the requested information is uploaded to the server 2 from the communication terminal 1. Then, the information is provided to the client terminal 3 and displayed on the client terminal 3.

Where no abnormality is detected as a result of the test of the test item, the operator inputs the test result from the client terminal 3. If the server 2 receives a test result such that the operation object component ranked at the highest priority is normal, the server 2 searches for recovery operation information about an operation object component ranked at the second highest priority, and provides the information (test item) to the client terminal 3 on the web page. Alternatively, the server 2 may perform the abnormality scoring operation again in consideration of a new test result, and provide another test item based on new abnormality scores.

The transaction between the server 2 and the client terminal 3 is repeated such that the operator can test the test items according to the priority order reasonably determined based on the configuration and the condition of the watercraft 5 to determine the cause of the trouble. This makes it possible to achieve early recovery from the problem condition while eliminating the useless test operation as much as possible.

Where the test item is tested by transmitting the troubleshooting request to the server 2, the server 2 acquires the detection value of the sensor from the communication terminal 1. Therefore, the information about the test result of the test item can be acquired without waiting for the input from the client terminal 3. In this case, therefore, the server 2 may provide a test item to be next tested to the client terminal 3 without waiting for a command from the client terminal 3.

Figure 10:
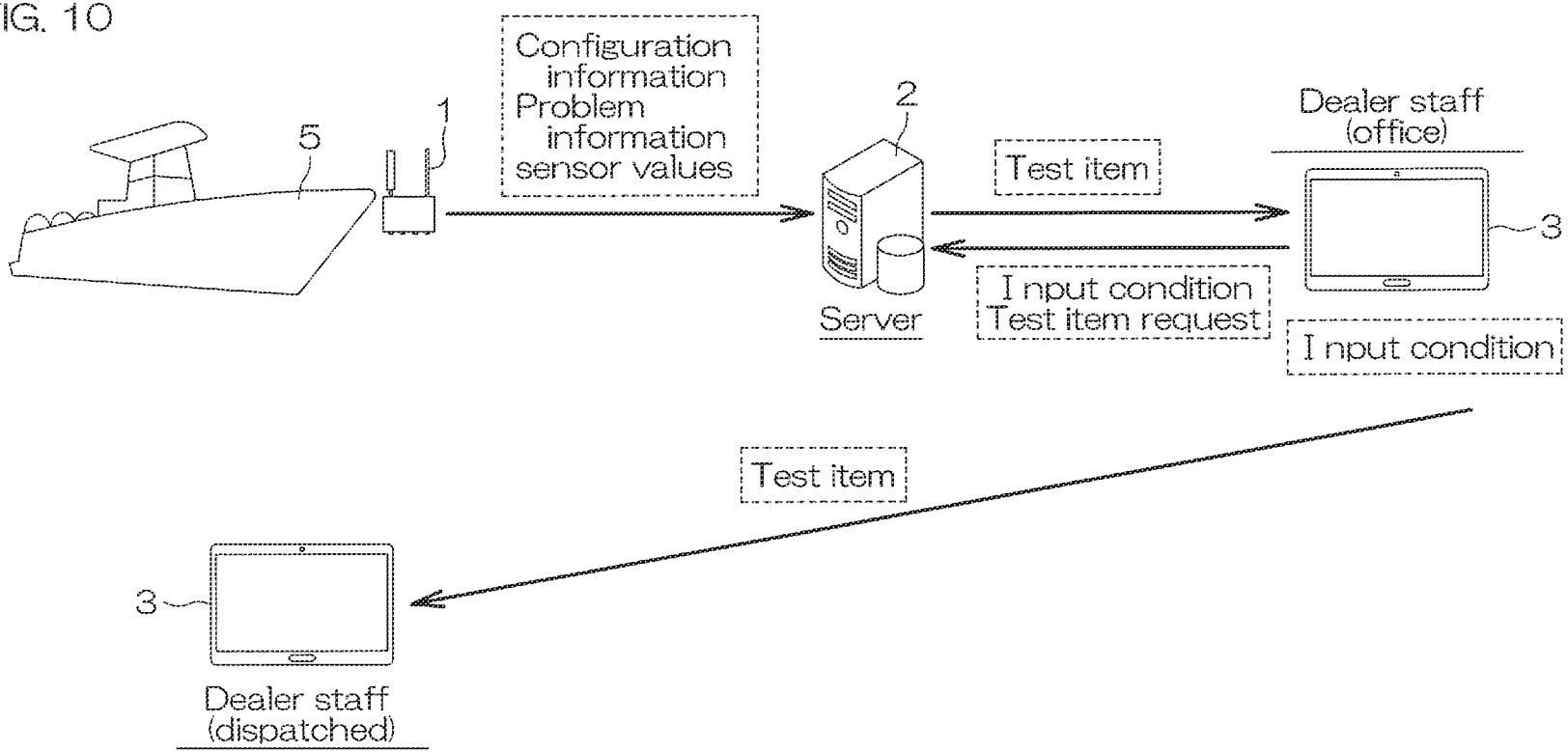
FIG. 10 shows an exemplary procedure to be followed when a problem condition occurs in the watercraft.

FIG. 10 shows an exemplary procedure to be followed when a problem condition occurs in the watercraft 5. Typically, a problem condition is reported from the owner or the user of the watercraft 5 to the dealer staff or the marina staff. The staff who has received the report operates the client terminal 3 to input the problem condition of the watercraft 5 on the web page provided by the server 2, and applies a test item request.

The server 2 which has received the condition data and the test item request refers to the configuration information C and the operation master M, and performs the process described with reference to FIG. 7 to provide the recovery operation information (test item) to the client terminal 3 on the web page. The configuration information C and other information necessary for this process are transmitted from the communication terminal 1 to the server 2, and accumulated in the server 2. As required, the server 2 may transmit the high-speed transmission mode command to the communication terminal 1 of the watercraft 5 to collect the configuration information C and other information. Thus, the communication terminal 1 is switched to the high-speed transmission mode, so that the information about the watercraft 5 (configuration information, problem information and various sensor values) is uploaded to the server 2 at a higher rate (high-speed logging) and accumulated in the storage 23 of the server 2.

The dealer staff or the marina staff (e.g., maintenance mechanic) performs the test operation and the like based on the information displayed on the client terminal 3. Where the watercraft 5 is present at a location remote from the dealer or the marina, the maintenance mechanic is dispatched to the watercraft 5 and performs the test operation and the like. In this case, the maintenance mechanic may operate and refer to the client terminal 3 near the watercraft 5. Alternatively, the dealer staff or the marina staff may operate and refer to the client terminal 3 to inform the maintenance mechanic about the test item near the watercraft 5.

According to a preferred embodiment of the present invention, as described above, the configuration information C about the watercraft 5 is transmitted to the server 2 by the communication terminal 1, and accumulated in the server 2. Therefore, the server 2 can generate a test item suitable for the configuration of each individual watercraft 5. Further, even if the configuration of the watercraft 5 is retrospectively modified by replacement or addition of a device, the server 2 can generate a test item suitable for the latest configuration of the watercraft 5.

When a problem condition appears in the watercraft 5, condition data is transmitted from the client terminal 3 to the server 2, and a test item is transmitted from the server 2 to the client terminal 3 according to the condition data. Therefore, the operator can properly find a test item suitable for the configuration of each individual watercraft 5 by operating the client terminal 3. This makes it possible to eliminate the problem occurring in the watercraft 5 with a reduced effort in a shorter period of time while minimizing a useless test procedure. That is, the operator does not need to select test items from a huge number of test items and prioritize the selected test items after understanding the situation of the watercraft 5 and organizing the information.

In a preferred embodiment of the present invention, the server 2 includes the operation master M, and the model-specific operation master information describing the condition and the test item for each of the various types of devices is registered in the operation master M. If the test item request for the specific watercraft 5 is received from the client terminal 3, the server 2 searches the operation master M based on the configuration information C about the specific watercraft 5 such that reference is made to the model-specific operation master information about the devices provided in the specific watercraft 5. Further, the server 2 finds a proper test item based on the condition data transmitted from the client terminal 3 with reference to the model-specific operation master information related to the condition. The client terminal 3 is informed of the test item thus found. Thus, a proper test item suitable for the configuration of the specific watercraft 5 is dynamically generated by searching the operation master M in which the model-specific operation master information for the various types of devices is registered. Thus, the operator can test the proper test item according to the configuration and the condition of the specific watercraft 5. This makes it possible to speedily recover from the problem condition without performing the useless test operation.

When a new product is supplied to the market, model-specific operation master information for the product may be registered in the operation master M such that a watercraft mounted with the new product can be covered. That is, the watercraft troubleshooting support system 100 can be configured to cover the new product by properly maintaining and updating the operation master M.

According to a preferred embodiment of the present invention, a problem condition causing device (e.g., a specific device or its component) can be properly narrowed down based on the abnormality scoring information described in the model-specific operation master information. Specifically, the abnormality scores of candidates of the problem condition causing device are computed, and a device or its component having the highest abnormality score is specified as a test object. Then, a test item for the device is determined. Thus, the test item can be properly determined according to the configuration of each individual watercraft and the problem condition. Further, when the test result of the test item is inputted, another proper test item to be next tested can be provided according to the test result.

In a preferred embodiment of the present invention, the abnormality scoring information includes the abnormality score computation rule associated with at least one of the configuration information, the condition data transmitted from the client terminal 3, or the detection values of the sensors provided in the watercraft 5. Thus, the abnormality score is properly computed. With the abnormality score computation rule associated with the configuration information, the scoring operation can be properly associated with the configuration of the watercraft 5. With the abnormality score computation rule associated with the condition data, the scoring operation can be properly associated with the problem condition. Further, with the abnormality score computation rule associated with the detection values of the sensors, the scoring operation can objectively reflect on the problem condition occurring in the watercraft 5. Thus, the proper test item can be provided to the client terminal 3.

While preferred embodiments of the present invention have thus been described, the present invention may be embodied in some other ways.

In a preferred embodiment described above, the client terminal 3 is configured to use the web application provided by the server 2 on the web browser by way of example. Alternatively, the client terminal 3 may be configured to use a dedicated application program installed in the client terminal 3.

In a preferred embodiment described above, the outboard motors are used as the propulsion devices by way of example, but the propulsion devices provided on the watercraft may be inboard motors, inboard/outboard motors, jet propulsion devices and other types of propulsion devices.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft troubleshooting support system comprising:

a communication terminal that transmits watercraft configuration information;

a server that receives the configuration information transmitted by the communication terminal, accumulates at least the configuration information for a plurality of watercraft, and generates a test item for each of the plurality of watercraft based on the accumulated configuration information; and a client terminal that communicates with the server, transmits condition data for a specific one of the watercraft to the server, transmits a test item request to the server, receives a test item from the server based on the test item request, and provides the test item to a user; wherein the condition data indicates that a problem condition appears in the specific one of the watercraft; and the test item indicates a test operation to be performed to determine a cause of the problem condition.

2. The watercraft troubleshooting support system according to claim 1, wherein the configuration information includes information about at least one device of the watercraft.

3. The watercraft troubleshooting support system according to claim 2, wherein the at least one device includes at least one main device.

4. The watercraft troubleshooting support system according to claim 2, wherein the configuration information includes information indicating at least one of a type, a number, a layout, or a connection state of the at least one device.

5. The watercraft troubleshooting support system according to claim 1, wherein the server includes an operation master including model-specific operation master information that describes a condition and the test item for the condition for each of various types of devices that could be mounted on each of the plurality of watercraft; and the server searches the operation master based on the configuration information and the condition data for the specific watercraft related to the test item request applied from the client terminal to specify the test item, and inform the client terminal about the specified test item.

6. The watercraft troubleshooting support system according to claim 5, wherein the model-specific operation master information includes abnormality scoring information that describes an abnormality score computation rule for computation of abnormality scores indicating abnormality possibilities of the at least one device or other devices;

the server computes abnormality scores of one or more of the at least one device based on the abnormality scoring information, and specifies one of the at least one device as a test object based on the computed abnormality scores, and determines the test item according to the model-specific operation master information for the one device thus specified.

7. The watercraft troubleshooting support system according to claim 6, wherein the abnormality score computation rule described in the abnormality scoring information is associated with at least one of the configuration information, the condition data transmitted from the client terminal, or a detection value of a sensor provided in the specific watercraft.

8. The watercraft troubleshooting support system according to claim 7, wherein the server receives information about a test result of the test item, generates a test item to be next tested based on the received information, and transmits the next test item to the client terminal.

9. The watercraft troubleshooting support system according to claim 1, wherein the communication terminal transmits at least one of failure information about a failure occurring in the specific watercraft or a detection value of a sensor provided in the specific watercraft to the server.

10. The watercraft troubleshooting support system according to claim 1, wherein the communication terminal spontaneously transmits information collected in the specific watercraft to the server, or transmits the information collected in the specific watercraft to the server in response to a request from the server.

11. The watercraft troubleshooting support system according to claim 1, wherein the client terminal ttransmits information about a test result of the test item specified by the server to the server.

12. A server for use in a watercraft troubleshooting support system including a communication terminal, a client terminal, and the server, wherein the server receives configuration information transmitted by the communication terminal, accumulates at least the configuration information for a plurality of watercraft, and generates a test item for each of the plurality of watercraft based on the accumulated configuration information;

the server communicates with the client terminal, receives condition data for a specific one of the watercraft from the client terminal, receives a test item request from the client terminal, transmits a test item to the client terminal based on the test item request, and provides the test item to a user;

the condition data indicates that a problem condition appears in the specific one of the watercraft; and the test item indicates a test operation to be performed to determine a cause of the problem condition.

* * * * *